US007216443B2

(12) United States Patent
Baden et al.

(10) Patent No.: US 7,216,443 B2
(45) Date of Patent: May 15, 2007

(54) ELEVATED SUPPORT MATRIX FOR A SHOE AND METHOD OF MANUFACTURE

(75) Inventors: Colin Baden, Irvine, CA (US); David Lee Davis, Newport Beach, CA (US)

(73) Assignee: Oakley, Inc., Foothill Ranch, CA (US)

( * ) Notice: Subject to any disclaimer, the term of this patent is extended or adjusted under 35 U.S.C. 154(b) by 91 days.

(21) Appl. No.: 11/098,011

(22) Filed: Mar. 31, 2005

(65) Prior Publication Data

US 2006/0218820 A1 Oct. 5, 2006

(51) Int. Cl.
*A43B 3/21* (2006.01)

(52) U.S. Cl. ..... 36/34 R; 36/103; 36/24.5

(58) Field of Classification Search ..... 36/27, 36/28, 29, 7.8, 34 R, 40, 103
See application file for complete search history.

(56) References Cited

U.S. PATENT DOCUMENTS

| | | | | |
|---|---|---|---|---|
| 39,370 | A | 8/1863 | Alexander | |
| 42,187 | A | 4/1864 | Griswold | |
| 267,167 | A | 11/1882 | Drandly | |
| 1,527,231 | A * | 2/1925 | Slough | 36/40 |
| D114,511 | S | 4/1939 | Renaldo | |
| 2,153,968 | A | 4/1939 | Loufbahn | |
| D122,166 | S * | 8/1940 | Korda | D2/966 |
| 2,284,326 | A | 5/1942 | Korda | |
| 2,284,327 | A | 5/1942 | Korda | |
| 2,284,328 | A | 5/1942 | Korda | |
| D146,885 | S | 6/1947 | Tullgren et al. | |
| 2,510,236 | A | 6/1950 | Kutcher | |
| 2,519,108 | A | 8/1950 | Bryant et al. | |
| 2,607,133 | A | 8/1952 | Marlowe | |
| 2,677,201 | A | 4/1954 | Lyon | |
| 3,032,896 | A | 5/1962 | Weaver | |
| 3,182,408 | A | 5/1965 | Ortega Torres et al. | |
| 3,719,965 | A * | 3/1973 | Chevallereau | 12/146 B |
| 3,925,915 | A | 12/1975 | Colli | |
| 4,041,618 | A | 8/1977 | Famolare | |
| 4,439,935 | A | 4/1984 | Kelly | |
| 4,593,482 | A * | 6/1986 | Mayer | 36/7.5 |
| 4,611,412 | A * | 9/1986 | Cohen | 36/28 |
| 5,317,822 | A | 6/1994 | Johnson | |
| 5,337,492 | A * | 8/1994 | Anderie et al. | 36/28 |

(Continued)

FOREIGN PATENT DOCUMENTS

DE 3429859 A1 2/1986

(Continued)

*Primary Examiner*—Ted Kavanaugh
(74) *Attorney, Agent, or Firm*—Gregory K. Nelson

(57) ABSTRACT

Disclosed is an elevated support matrix for a shoe, which may either form a sole, heel, or sole and heel combination. The matrix is formed of metal, or other high-tensile materials. To minimize the weight of the matrix, but still maintain the structural integrity of the matrix and properly support the wearer's foot, passageways are created in the matrix. The passageways result in void space and lattice, which have corresponding volumes. The increased volume of void space correlates with an overall weight reduction. A support matrix is thus provided that takes advantage of higher-tensile materials to create a reduced weight structurally maintained support matrix. Methods of manufacturing the matrix are also disclosed.

20 Claims, 7 Drawing Sheets

U.S. PATENT DOCUMENTS 5,822,886 A * 10/1998 Luthi et al. ..... 36/28
5,996,261 A 12/1999 Nelson
6,094,844 A 8/2000 Potts
6,581,255 B2 6/2003 Kay
6,640,464 B2 11/2003 Hsin et al.
6,655,048 B2 12/2003 Moretti
6,763,611 B1 * 7/2004 Fusco ..... 36/28
6,769,202 B1 * 8/2004 Luthi et al. ..... 36/28
D515,795 S * 2/2006 Baden et al. ..... D2/965
2002/0174569 A1 11/2002 Tsai
2002/0194750 A1 12/2002 Feick
2003/0233772 A1 12/2003 Musial
2004/0154189 A1 * 8/2004 Wang ..... 36/28

FOREIGN PATENT DOCUMENTS

GB 2 143 420 A 2/1985

* cited by examiner

ELEVATED SUPPORT MATRIX FOR A SHOE AND METHOD OF MANUFACTURE

FIELD OF THE INVENTION

The present invention relates generally to the lower portion of shoes, and more particularly to the support matrix of a shoe with passageways through it, configured and oriented to maintain the structural integrity of the sole while minimizing the weight of the shoe.

BACKGROUND OF THE INVENTION

A wide variety of shoes are on the market today. Generally, shoes are comprised of a lower portion for supporting a foot and an upper portion for securing the foot on or within the shoe. As shoes and related technology have improved over the years, so has their variation and functionality. The prior art discloses many shoes that are contoured and designed for a variety of purposes. Elevated shoes have generally been made of either wood or rubber materials. Each has their benefits and drawbacks. Woods, for example, are sturdy, but can be bulky, heavy and present limitations as to aesthetic options in design. Rubber soles are generally lighter, but tend to lose their shape over a period of time, and do not allow for a great deal of structural engineering or detail within the sole. The use and manipulation of newer materials with high-tensile strength provides a means for making soles and heels for shoes with design and sculpture to them, while still optimizing the structural integrity of the shoe and minimizing the weight the shoe.

SUMMARY OF THE INVENTION

There is provided in accordance with one aspect of the present invention a shoe comprised of a shoe upper and a lower portion of the shoe, referred to as the support matrix, formed from metal or other high-tensile materials for use with the shoe. As determined by the functionality and design of the matrix, a certain percentage of the matrix will be comprised of metal, composite, or other high-tensile materials. As a result of being formed of these types of materials, the matrix would, in many instances, be undesirably heavy for regular use as a shoe. Accordingly, the mass of the matrix necessarily must be reduced in a manner that optimizes and maintains the structural support to the matrix while also minimizing its weight.

The invention provides for a matrix, which is the lower portion of a shoe that supports a wearer's foot. The matrix has a top and bottom surfaces, and anterior, posterior, lateral, and medial sides, which together form its bounds. The matrix is further comprised of a lattice and a plurality of voids, where the voids are bounded by the lattice. The lattice has a structure that maintains the integrity of the matrix under pressure, while minimizing its weight.

One embodiment of the present invention comprises a matrix having at least one aperture, or opening, extending into one or more of the sides of the matrix. For design and functionality purposes, in some embodiments it is preferable that the aperture(s) extend into the either the medial, lateral, anterior, and/or posterior side of the sole. The size and number of apertures within the matrix are considerations of functionality and design that can help minimize the weight of a metal matrix, but still optimize and maintain the structural support of the matrix. In some embodiments, there will be at least 8 apertures in the sole, at often times at least 10 apertures, other times at least 20, and in some embodiments at least 50 apertures. In some embodiments, however, one aperture that is sufficiently large may suffice to achieve the balance of reduced weight and structural support.

There is provided in accordance with another aspect of the invention, passageways extending through the matrix. In some embodiments, it is preferable that aperture(s) communicate from one side of the matrix to another side, forming a passageway extending, for example, from the medial side to the lateral side of the matrix. The passageway has a central, longitudinal axis that is either linear or non-linear. A passageway's axis may, but need not be, parallel with the top or bottom surface of the sole. Moreover, the opening of one end of the passageway may or may not be the equidistant from the ground, as compared with the opposite opening. The size and number of passageways within the sole are considerations of functionality and design that can help minimize the weight of a metal matrix, but still optimize and maintain the structural support of the sole. In some embodiments, there will be at least 5 passageways in the sole, at often times at least 10 apertures, other times at least 15, and in some embodiments at least 25 passageways.

The voids, as bounded by the lattice, form passageways, as described above. In some embodiments, it is preferable that the passageways are substantially parallel with the bottom surface of the sole. In other embodiments, it is preferable that the openings of the passageways are equidistant from the bottom of the soles, whereas in still other embodiments, it is preferable that the distance from the center of one opening to the bottom surface is greater on one side than its corresponding side. Consequently, it is possible to form passageways that lie at pronated or supinated angles from one side to the other side of the sole.

In accordance with a further aspect of this invention, the lattice and voids define lattice space and void space, respectively, and the matrix has a total volume equal to the lattice space plus void space. As provided by the invention, it is preferable that the void space represents at least 10 percent of the total volume of the matrix, preferably at least 25 percent, often times at least 50 percent, and in some embodiments at least 75 percent of the total volume. The volume of void space can also be expressed as a ratio of void space to solid space.

In accordance with a further aspect of this invention, the sides of the matrix have a total area equal to closed area defined by the lattice plus open area void space. The void area represents at least 10 percent of the total area of any given side of the matrix, preferably at least 25 percent, often times at least 50 percent, and in some embodiments at least 75 percent of the total volume. The area of open, void space can also be related as a ratio of void space to solid space.

In accordance with a further aspect of this invention, the voids extend through the sole horizontally and form various shapes. The shape of a void is functional, in many instances, to maintain the structural integrity of the sole in the given design format. The voids may be comprised of uniform or varying sizes of circular, squared, diamond, hexagonal, elliptical, or honeycomb, or any combination of these or other shapes. Preferably, the void shapes all have some radius on the edges that blunts the edges so that there are no right angles in the void shapes.

There is provided in accordance with a further aspect of the invention, at least one connector for connecting the upper to the sole, which is an integral connector. The connector may be a mechanical interfit structure(s), snap(s), connector(s) extending through a passageway, solder, bonding, or rivets. Those with skill in the art will recognize that there are also other methods of connecting the sole to the upper.

In accordance with a further aspect of the invention, there is provided a compartment for holding at least one item within the sole of the shoe. The compartment is preferably in at least one of the voids. In some embodiments, the compartment is preferably formed by having at least one panel hingeably attached to one of the sides of the shoe. In some cases, the panel further comprises a lock. In other embodiments, the panel is formed by at least one sliding panel carried by one of the sides of the sole, and in some embodiments has a lock.

In accordance with another aspect of the invention, there is provided a method for making a light-weight, integrity-enhanced elevated sole for a shoe. The first step of this method is to select a material from which to form a sole for a shoe. Depending on the functionality and design of the shoe, the shoe may be made from various metals, foaming resin, composits, plastic, butyl styrene, nylon, glass-filled nylon, acrylic or other sufficiently dense, strong tensile materials. The second step is to form the sole into a desired matrix having a general shape and dimensions, having an elevated heel or sole that is at least one inch thick. Last, apertures or passageways of sufficient number and size are formed through the sole in a manner to form a lattice and void space, which will reduce the weight of the sole and optimize the integrity of the sole.

In accordance with a further aspect of this invention, the apertures or passages are formed by investment casting, injection molding, milling, laser cutting, water cutting, sand blasting, airblasting, de-alloying, melting materials away, or chemical interaction.

In accordance with a further aspect of this invention, a method is provided for attaching a strap to a metal sole for a shoe having at least one passageway extending through it. A bonding surface is attached to the metal sole, with a leather surface attached thereon to form a footdeck. A strap is also attached to the matrix. The strap is attached between the bonding surface and leather surface, looping the strap through a passageway, or attaching the strap by snaps or by at least one mechanical interfit. In some embodiments, the bonding surface is attached to the metal matrix with rivets. In still other embodiments the strap loops or threads through the void space of the matrix.

In accordance with another aspect of this invention, a method is provided for attaching a footdeck to a top surface of a metal matrix. The sole is comprised of at least one passageway opening at the top surface of the sole of the shoe. At least one of the top surface passageways is filled to better form a level support surface to bond material to form the footdeck. A bonding surface is then attached to the top surface, and a leather surface attached thereon. In some embodiments, the bonding surface is attached to either or both of the metal surface and/or the filling material with rivets.

Further features and advantages of the present invention will become apparent from the detailed description of preferred embodiments that follows, when considered together with the actual claims and drawings.

DETAILED DESCRIPTION OF THE PREFERRED EMBODIMENT

The present invention is generally directed to a novel shoe with apertures or passageways in the sole or heel, or both, of the shoe to reduce the weight of the shoe, but still optimize and maintain the structural integrity of the shoe. Though the specification will generally describe the sole or heel of a shoe being formed from metal, it will be understood by those with skill in the art that the sole or heel described may be formed of many different materials that have a relatively high tensile strength for shoes. Moreover, it will be understood by those with skill in the art that the invention can be applied to numerous shapes and styles of shoes. The present invention provides the advantage of making an elevated shoe from high-tensile strength material, such as metal, in such a manner as to minimize the weight of the shoe while stabilizing the foot and resisting deformation of the structure of the shoe. This is accomplished by placing apertures or passageways in the sole, heel, or both of the shoe with sufficient number and size to reduce the weight of the shoe so that it is more comfortable to wear than a similar shoe bearing the full weight of the shoe, while still supporting the wearer's foot and maintaining the integrity of the shoe.

Figure 7:
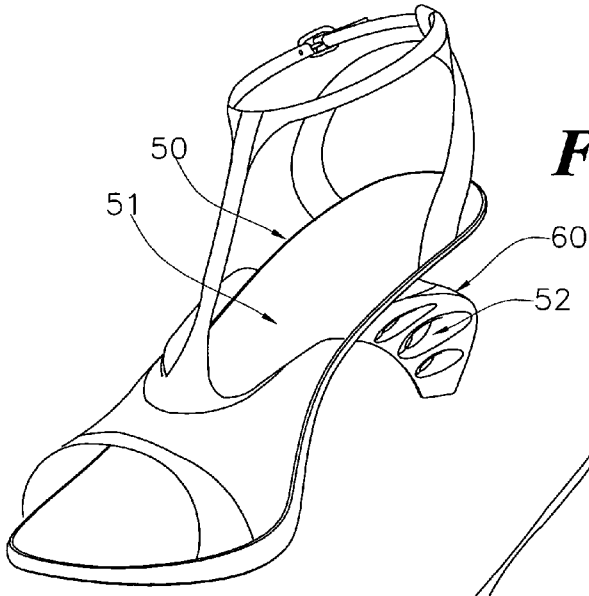
FIG. 7 is a perspective view of a shoe having an elevated heel with passageways through the heel and attached to the sole of a shoe.

The present invention is generally directed to the lower portion of a shoe. Typically, a shoe is comprised of an upper-portion and lower-portion. The upper portion is generally that portion of the shoe that encompasses the sides and top portion of the wearer's foot, and in many instances is formed of leather, suede, fabric, and the like. The lower portion of the shoe is generally comprised of the sole or heel, or both, which interface with the bottom surface of the wearer's foot. The bounded surface of the lower portion of the shoe forms a support matrix, for purposes of this invention. Depending on the designed shape of the show, the matrix may be either a wedge-shape sole, a sole and heel, or only a heel. In the case of a wedge-type shoe, like the one depicted in FIG. 4, there is no distinct heel and sole, but only a sole 35, which would form the matrix. As shown in FIG. 7, some designs essentially have no sole, but merely a thin platform 51 to support the bottom of the wearer's foot, with a heel 60 attached to the bottom surface of the sole to elevate the shoe. In this case, the matrix is comprised of only the heel 60. In other embodiments, such as FIG. 1, there is an elevated sole 8 and heel 15 combination.

Figure 1:
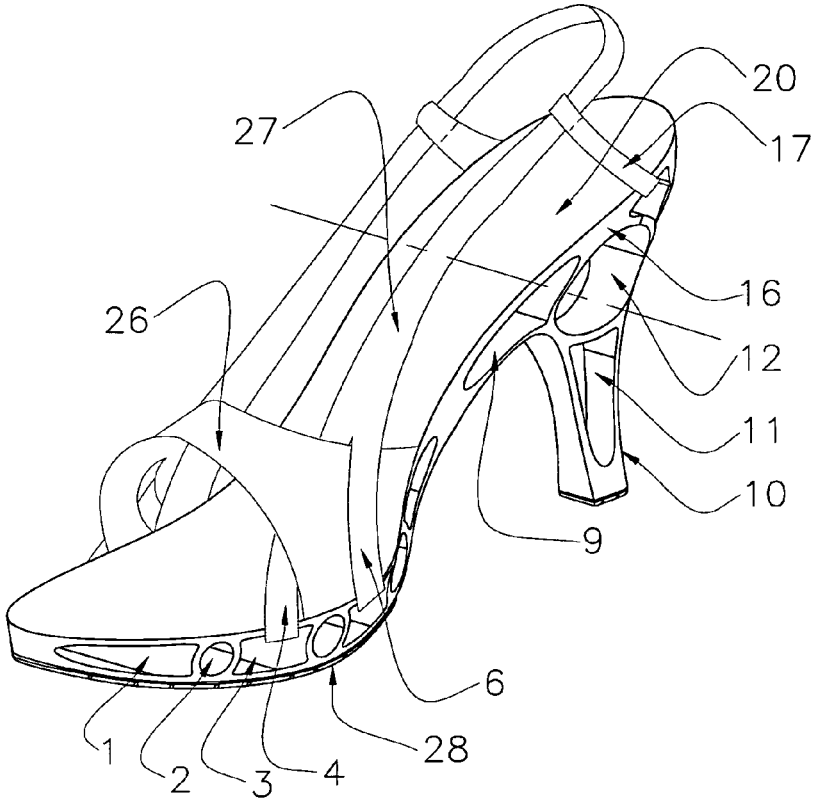
FIG. 1 is a perspective view of a women's shoe having an elevated, metal sole and heel with apertures and passageways in the sole and heel formed by milling.
Figure 2:
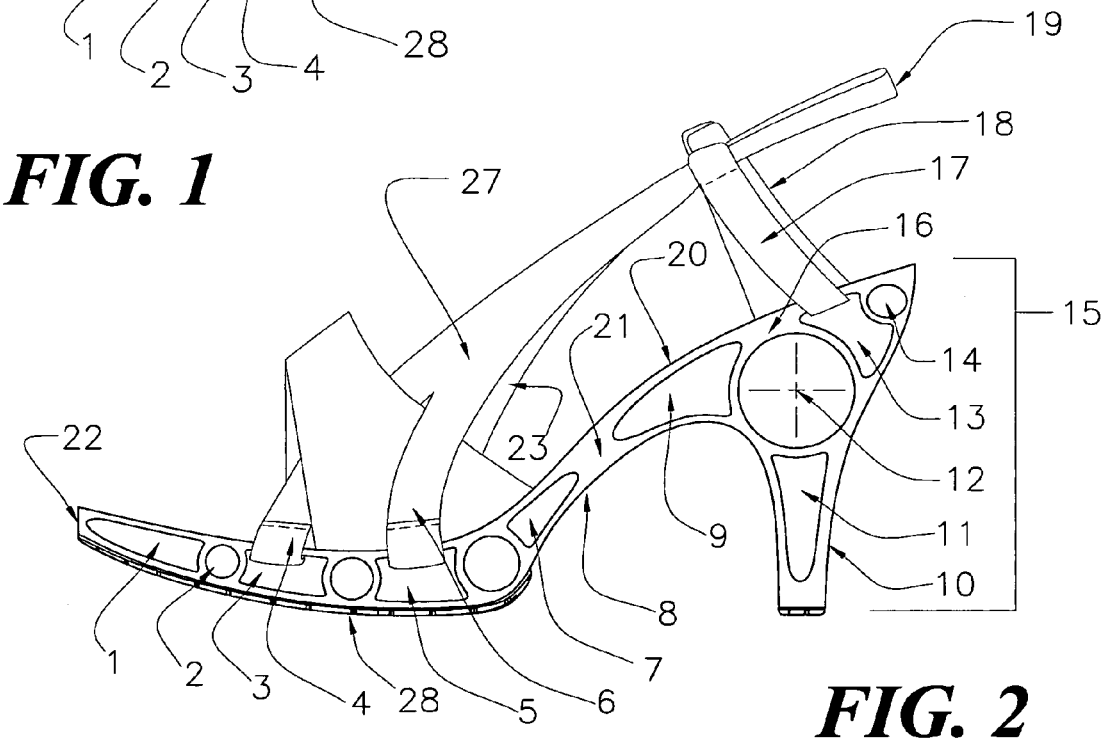
FIG. 2 is a side perspective view of the shoe of FIG. 1, showing void and solid space created by the apertures and passageways of different shapes and sizes within the soles and heel of the shoe.
Figure 3:
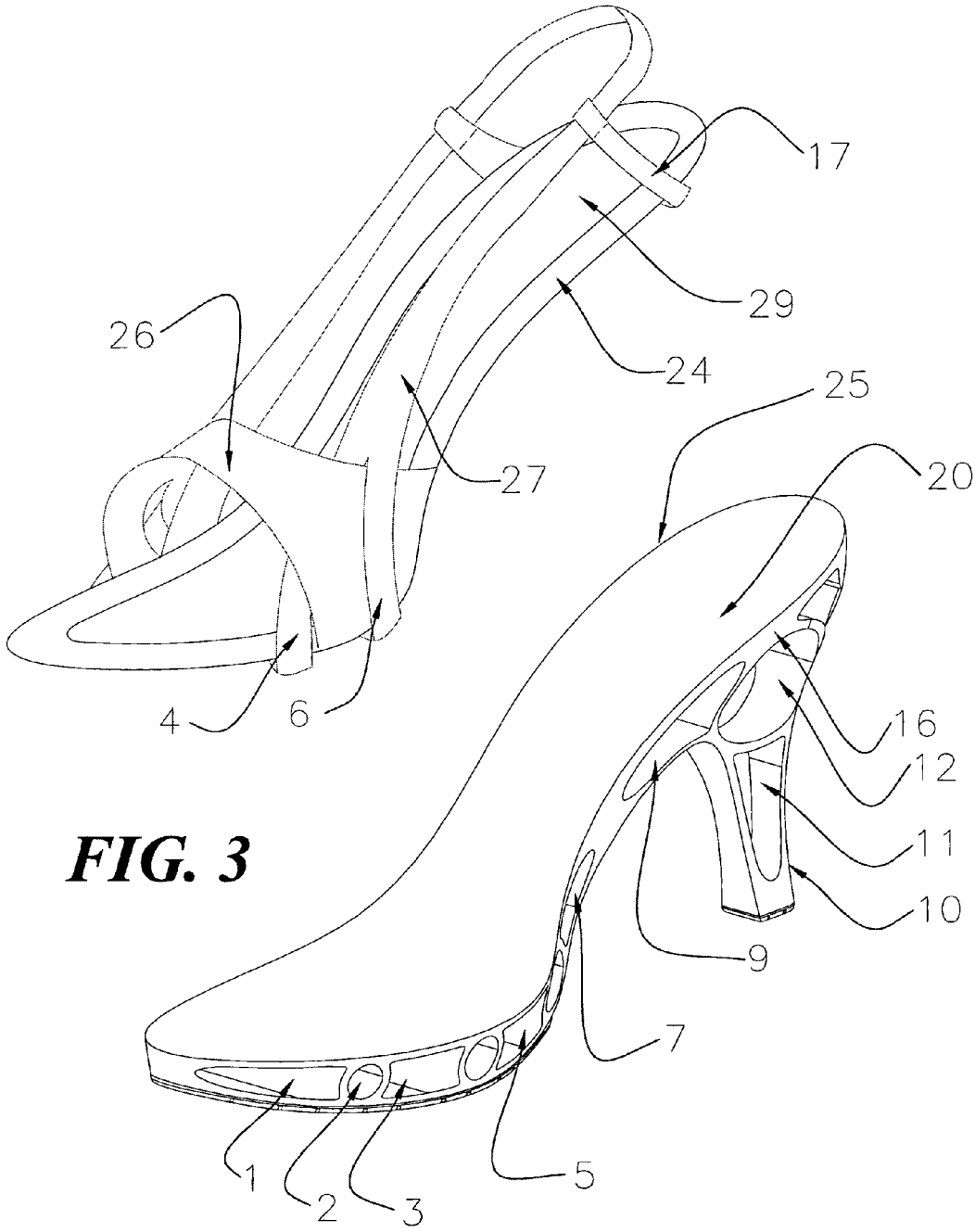
FIG. 3 is an exploded perspective view of a metal shoe showing the assembly of a metal shoe.

As illustrated in FIGS. 1–3, the matrix 21 is comprised of lattice 16 and void space 12, for example. As apertures or passageways, which may be of any number, extend through the sole 8, a lattice 16, or solid framework, is left behind. The lattice 16 borders and defines void space 12 within the matrix 21.

Referring to FIG. 1, the shoe is comprised of an upper 26 attached to an elevated metal sole 8 and heel 15 for a shoe with passageways, 1–3, 5, 7, 9, and 11–14, in the sole 8 and heel 15, which form the matrix 21 for this exemplary embodiment. The sole 8 has a top 20 and bottom 28 surface, an anterior side 22, posterior side 10, medial side, lateral side, and is connected to the shoe upper 26. As shown in FIG. 1, the general shape of the sole 8 and heel 15 are dictated by design functions. The vertical thickness of the sole 8 or heel 15 is largely based on the desired functionality and design of the shoe. In some embodiments the total vertical thickness of the sole 8 and/or heel 15 is at least ½ inch thick, at least 1 inch thick in other embodiments, 1½ inch thick in still other embodiments, at least 2 inches thick in still other embodiments, and at least 2½ inches thick and greater in still other embodiments.

In some embodiments, it will be preferable that the entire sole 8 and heel 15 be comprised of metal, or other high-tensile materials, whereas in other embodiments it will be preferable that a portion of the sole 8 or heel 15 be metal, or other high-tensile materials. The sole has a total surface area along its top surface 20, which interfaces with the bottom of a wearer's foot. As determined by the functionality and design of the sole 8, a certain percentage of the sole 8 will be comprised of metal or other high-tensile materials; In some embodiments, it is preferable that the horizontal surface area of the top surface 20 of the sole is at least 25 percent metal, often times at least 50 percent metal, and in some embodiments represents at least 75 percent.

As a result of being formed of metal, or other high-tensile materials, the matrix, in many instances, would be undesirably heavy for regular use as a shoe if there were no void space. Accordingly, the mass of the matrix must be reduced in a manner that optimizes and maintains the structural support to the shoe while also minimizing the weight. The matrix can have either or both of apertures or passageways. An aperture is an opening or carve-out on one side of the matrix that does not communicate to any other opening. A passageway is a lumen having an opening on each end that communicates with the outside of at least two sides of the matrix.

In one embodiment of the present invention the shoe has at least one aperture into one or more of the sides of the sole. For design and functionality purposes, in some embodiments it is preferable that the aperture(s) extend into the either the medial, lateral, anterior, or posterior side of the sole, whereas for some designs and materials it will be desirable to include apertures on more than one of the sides of the shoe. The size and number of apertures within the sole are also a consideration of functionality and design that can help minimize the weight of a metal sole, but still optimize and maintain the structural support of the sole. In some embodiments, there will be at least 8 apertures in the sole, at often times at least 10 apertures, other times at least 20, and in some embodiments at least 50 apertures.

Referring to FIG. 2, there is provided in accordance with another aspect of the invention, passageways, 1–3, 5, 7, 9, 11–14, extending through the matrix 21, for example, from the medial side to the lateral side of the matrix. There is no required size and number of passageways within the matrix, which are also a consideration of functionality and design to minimize the weight of a metal sole, but still optimize and maintain the structural support of the sole. In some embodiments, there will be at least 5 passageways in the sole, at often times at least 10 apertures, other times at least 20, and in some embodiments at least 50 passageways.

The sole 8 and heel 15 of the matrix 21 in FIG. 2 are comprised of multiples shapes and dimensions of shapes to accommodate the given matrix. The sole 8 portion of the matrix 21 is comprised of triangular 1, 7, circular 2, and trapezoidal 3, 5 shapes of smaller proportion at the thinner portions of the sole. As the sole 8, and subsequently the heel 15, get bigger, so do the proportions of the shapes 9, 11, 12. To fit different shapes of the of matrices, different shapes may be employed at different parts of the matrix, including, but not limited to, circular, squarish, triangular, trapezoidal, elliptical. Governed by the general shape of the matrix, it will be preferable in some instances that the shapes have a unitary shape, whereas in other instances, it will be preferable to have the same shape with varying size and dimensions. Further, in still other instances, it may be preferable to accommodate the size and fit of a matrix by having void space characterized by multiple shapes, as in FIG. 2. FIG. 2 clearly presents examples of where particular shapes of void space are preferable within the matrix, to remove mass, but maintain the structural integrity of the shoe. In all instances, however, it is preferable that the void space, bordered by the lattice 16, should not have any linear angles. Linear angles create the potential for break, or fissure, points. Accordingly shapes, such as triangles 1, 7, 9, 11, which normally have angles, are blunted with some radius of curvature at their transition points instead of angles.

FIG. 2 shows several examples of passageways that are parallel to the bottom of the shoe, as illustrated by a planar line running through passageway 12. However, in some embodiments, it may be preferable that at least one or more of the passageways are not parallel with the bottom surface 28 of the shoe. Each passageway has a central, longitudinal axis 12 that may be either linear or non-linear. In general, the passageway's axis may, but need not be, parallel with the bottom surface 28 of the matrix. In some cases, the passageways will lay in a pronated orientation. In other cases, the passageways will lay in a supinated orientation. In still other orientations, the passageways may form an arc.

In certain embodiments, it is also preferable to align passageways in certain angles or configurations to enhance structural support for a sole. Some designs for a matrix anticipate numerous passageways in the sole. As a result, the integrity of the matrix could be weakened. One way to optimize and maintain the structural integrity of the sole is to design the matrix so that the passageways lie on a path that is not parallel with the bottom surface 28 of the matrix.

The invention, in whatever form or shape the matrix takes, is further defined by its volume. As with any object, the shoe's matrix has a volume, whether that be for a matrix comprised of a sole, heel, or sole and heel. Considering for example, the metal shoe of FIGS. 1–2, the lattice 16 forming the structure of the sole 8 and heel 15 has a volume, which can be calculated. Taking the matrix of FIG. 1, as an example, it would be obvious for one with skill in the art to calculate the volume of the lattice 16 using a graduated cylinder, graduated jug, or the like. For example, one could seal all the void spaces of the sole 8 and heel 15 in the matrix so that no liquid could enter the void space. This sealing can be done with any material, such as duct tape, that has a negligible volume but which will not allow water to seep into the void space of the matrix. According to commonly known scientific principles, by sealing the matrix, one can create the equivalent of the matrix as if there had never been void space created therein. Then, having previously poured water into a graduated jug to a predetermined amount, one could lower the sealed matrix into the water using a string, or some other material with negligible volume. When the matrix is lowered into the water, the water level in the graduated cylinder will rise by an amount equal to the volume of the sealed matrix, which is the complete volume of the matrix, or $V_M$. Thereafter, the matrix is unsealed again, and the process of lowering the matrix into the water is repeated. In this second instance, the water level will rise by an amount equivalent to the volume of the unsealed matrix, which will be less than the complete volume previously measured for the matrix. This second volume represents the volume of the lattice 16, or solid space, $V_L$. The difference between the complete volume of the matrix and the unsealed volume of the lattice, $V_M-V_L$, equals the volume of the void space, $V_V$. Those with skill in the art will also recognize that there are various computer programs and other methods for calculating the volumes of the matrix, lattice, and void space.

The volume of void space represents a percentage of the complete volume of the matrix, $V_V/V_M$. In some embodiments, the void space, $V_V$, represents at least 10 percent of the total volume of the matrix, preferably at least about 25 percent, often times at least about 50 percent, and in some embodiments at least about 75 percent of the total volume. The volume of void space can also be related as a ratio of void space to solid space. Those with skill in the art understand that as shoes come in different sizes, the physical dimensions of each size of shoe will change. Consequently, the dimensions of apertures or passageways, represented by void space, will also change with the size of shoe. However, the percentage of void space volume to complete matrix volume will remain generally consistent.

The invention is further defined by its surface area. A view of any of the side profiles of the matrix will reveal the matrix's surface area. Referring to FIG. 2 as an example, the surface area of the lateral side of the matrix can be characterized as solid surface, comprised of the lattice, and void surface, comprised of the void space. The sum of solid surface and void surface will total the complete surface area of the side of the matrix, if there were no void space. Several methods are available to measure the surface area of a figure, either manually or electronically, which will be obvious to those with skill in the art. One way to measure the surface area is with a computer program, such as ALIAS®, which can calculate the surface area of various objects. To use a program, such as ALIAS®, however, a drawing or profile generally needs to be imported into the program. This can be done in various ways, including importing CAD files, tracing an object and scanning the traced profile, or performing a 3D scan of an object. Once the images are uploaded, various measurements can be done.

Figure 10A:
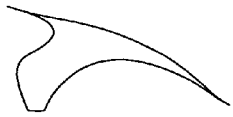
FIGS. 10*a*–10*c* show computer renderings for measurements of the complete surface area, solid surface area, and void surface area of the heel of a shoe.
Figure 10B:
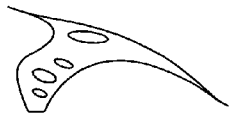
Figure 10C:
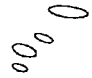
Figure 11A:
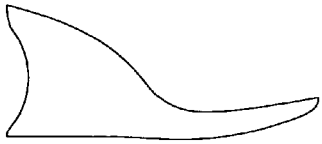
FIGS. 11*a*–11*c* show computer renderings for measurements of the complete surface area, solid surface area, and void surface area of the sole and heel of a shoe.
Figure 11B:
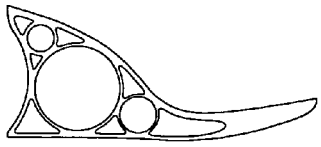
Figure 11C:
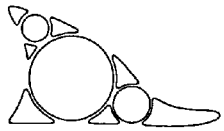
Figure 12A:
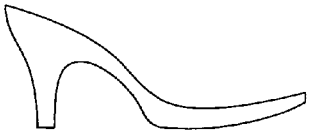
FIGS. 12*a*–12*c* show computer renderings for measurements of the complete surface area, solid surface area, and void surface area of the sole of a shoe.
Figure 12B:
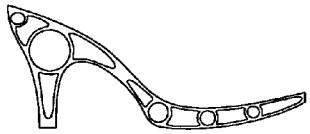
Figure 12C:
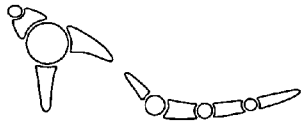

FIGS. 10–12 are illustrative of the surface area measurements done with a computer program, such as ALIAS®. There particular images are from imported CAD files. After the files are imported, the user can select what views to work with. The first picture in all three figures (10*a*, 11*a*, 12*a*) shows the matrix of each exemplary shoe with no void space, $A_M$. Calculations can then be done with the computer program to accurately calculate the complete surface area of the matrix, if there were no apertures or passageways. The second picture illustrates the image of the lattice of the matrix (10*b*, 11*b*, 12*b*), $A_L$ which again is used to calculate the surface area of the lattice. Finally, by selecting only the void space (10*c*, 11*c*, 12*c*), $A_V$ one can use the program to calculate the surface area represented by the void space. Accordingly, with these numbers, the sole can be represented as a percentage of void surface area to complete surface area, $A_V/A_M$.

Minimization of weight for an elevated matrix, whether sole or heel or both, made of metal and other high-tensile materials will reflect increasing amounts of void surface area, based on the material and design implemented. In some embodiments, the void surface area $A_V$ represents at least about 10 percent of the total surface area ($A_M$) of any given side of the matrix, preferably at least about 25 percent, often times at least about 50 percent, and in some embodiments at least about 75 percent of the total area ($A_M$). The area of open, void space can also be related as a ratio of void space to solid space. Again, though the physical dimensions of open space may change with different size shoes, these percentages will generally remain consistent.

Referring to FIG. 3, there is also provided with the present invention a method of attaching the upper portion of the shoe 26 and a strap 27 to a metal soled 25 shoe. Having a metal sole or platform, or soles of other new materials, presents a unique problem of attaching the footdeck 24 to the sole. To alleviate this problem, a bonding surface must first be attached to the top surface 20 of the sole. A leather surface, as well as any additional padding, can then be attached on top of the bonding surface to form an integral footdeck 24 for the shoe. Finally, at least one strap 26, or other material for securing the wearer's foot to the sole, is attached. In some embodiments, it may be preferable to attach the bonding surface with rivets, whereas in others, mechanical interfits will be preferable, and whereas in still others, simple snaps would be more preferable. It is also possible to secure at least one strap between the bonding and leather surfaces.

FIG. 3 also illustrates a method of attaching a strap 27 to a metal sole by looping or threading it through the void space 3, 5. In some embodiments, the ends 4, 6 of a strap can be looped through one of the void spaces 3 in the sole 8. By threading or looping the strap, the void space serves as an anchor to hold extensions 4, 6 of the strap 27 in place and apply appropriate tension to the foot of the wearer to maintain contact with the sole. This method may be preferable to allow the wearer some flexibility in how best to conform the strap to the wearer's foot. In other embodiments, the looped strap may be adjustable. For example, the strap can have a mechanical interfit or snap, which is disposed in a portion of the strap looped through the sole 8, which can be undone. Then the strap can be adjusted or moved to one of the other passageways and reattached.

Figure 4:
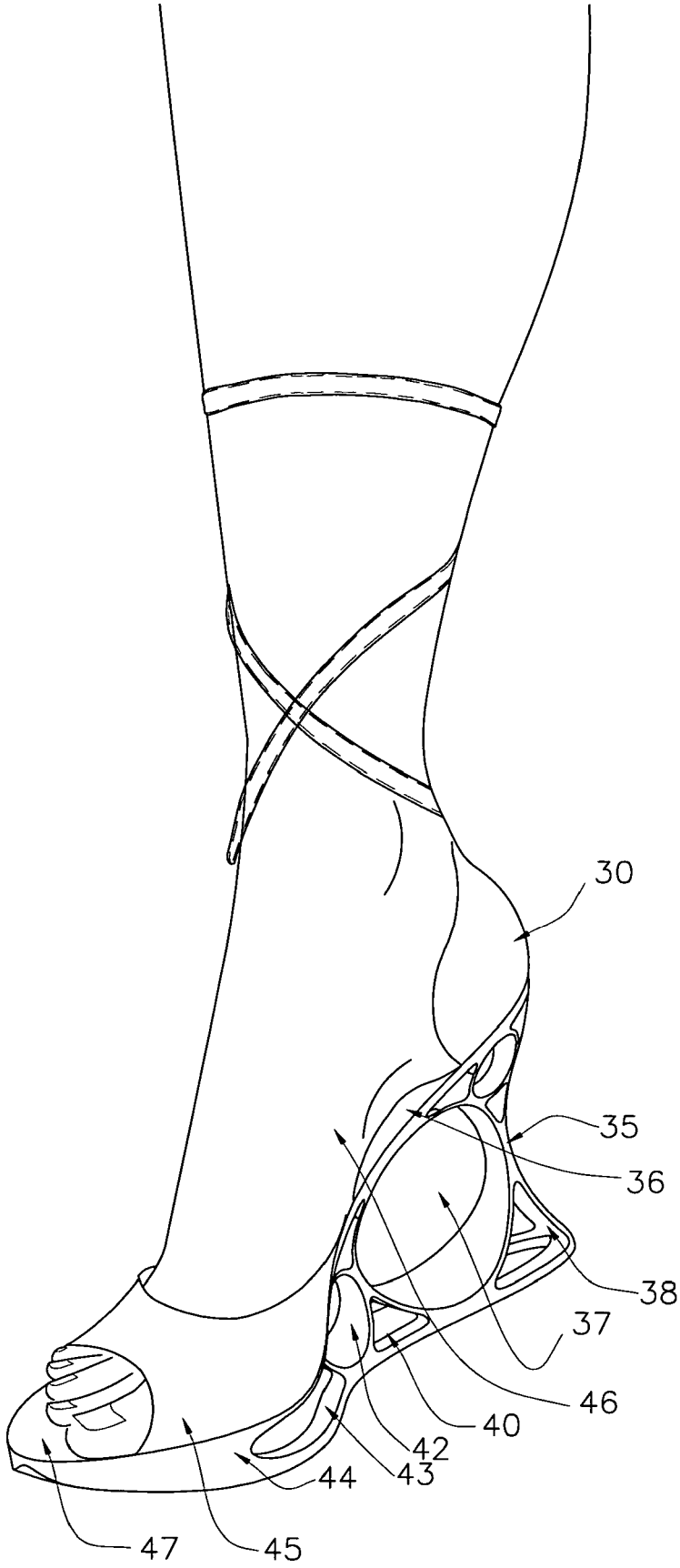
FIG. 4 is a perspective view of the matrix of an elevated shoe, formed by extrusion, comprised of a lattice and void space.

FIG. 4 illustrates another exemplary embodiment of the present invention. Referring to FIG. 4, the matrix 53 is comprised of only a sole 35; there is no distinct heel portion of the matrix 47. Further, the matrix has substantial amounts of void space such as illustrated by passageway 37, which will be preferable in some designs. The remaining lattice 44 structure effectively serves as a chassis to attach the remaining portions of the shoe, such as, optionally, a bottom surface 28 for contacting the ground and a footdeck 57 for interacting with the foot of the wearer.

Figure 5:
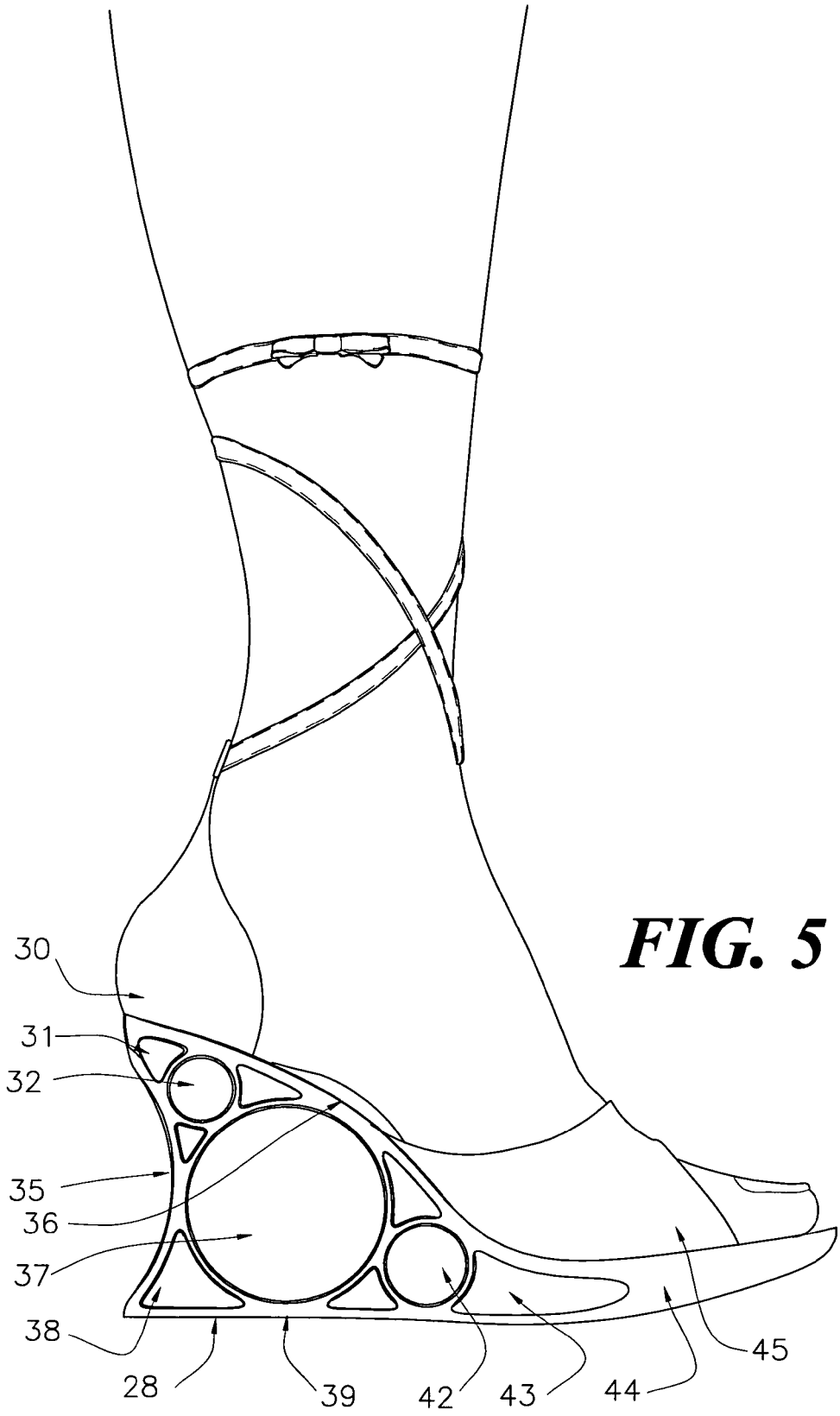
FIG. 5 is a side elevational view of the elevated shoe of FIG. 4, showing the lattice structure and void space of various sizes and shapes.

Referring to FIG. 5, the substantial amount of void space for a chassis-style matrix formed of passageways is shown. As in FIGS. 1 and 2, above, the void space can be comprised of multiple shapes, such as circular 37 and triangular 38 shapes, as well as different sizes 31, 32 of shapes.

To maintain the structural integrity of this chassis-style matrix of FIG. 5, a particularly high tensile-strength material, such as titanium or Oakley X Metal® should be used. Once the lattice border is sufficiently minimized, the matrix is extremely lightweight. A bottom surface 28 can or cannot be attached to the matrix for contacting the ground. A footdeck 57 is also attached for supporting the bottom of the wearer's foot.

Figure 6:
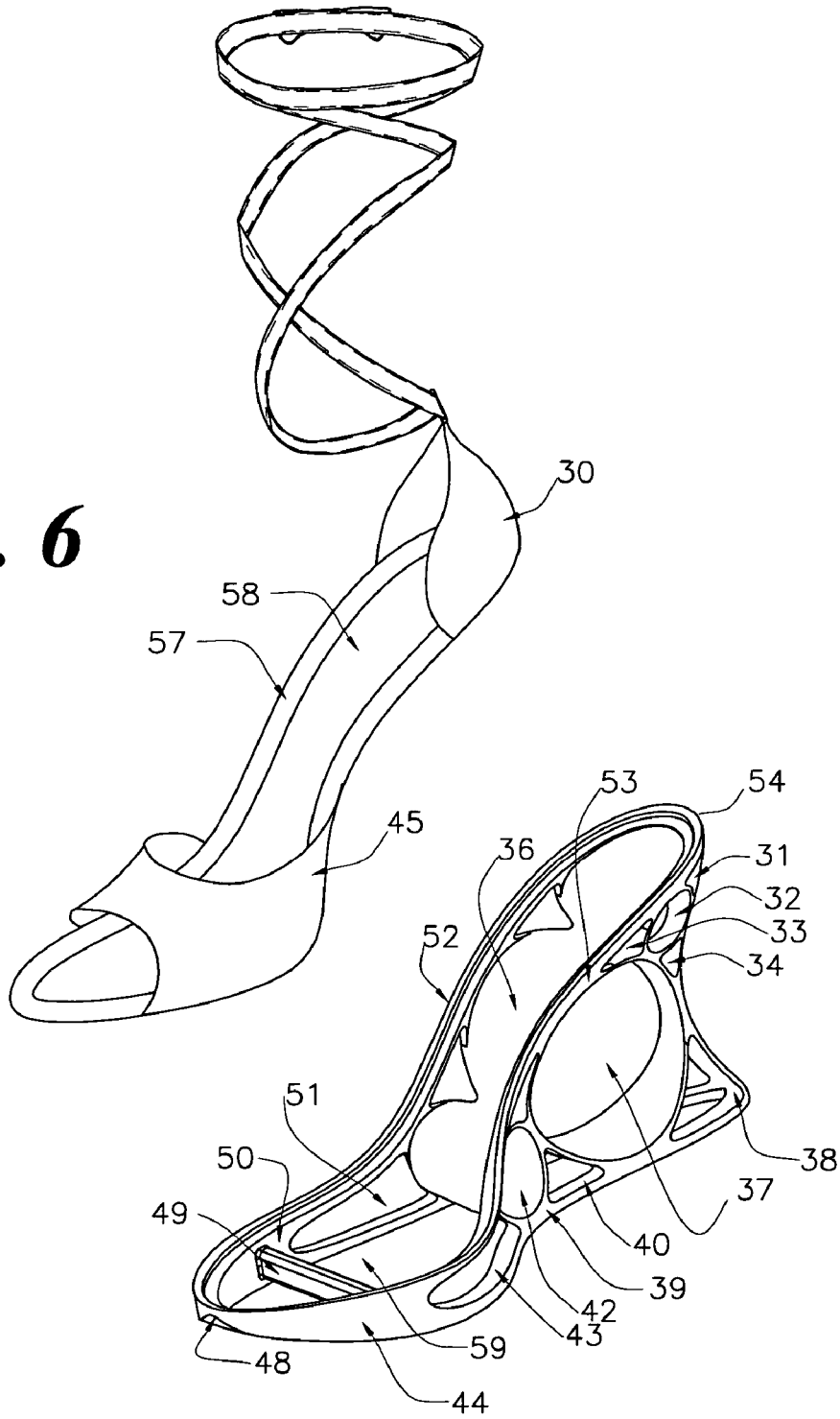
FIG. 6 is an exploded perspective view of the matrix and footbed and straps for the elevated shoe in FIG. 4

Referring to FIG. 6, still another provision of this invention is the unique situation where a metal chassis-style matrix 53 has been formed. As illustrated in FIG. 5, in some embodiments, the void space may be great, perhaps more than half the total matrix volume. In such situations, void space may extend into the top 36 or bottom 28 surfaces. To be able to attach a top or bottom surface, provision needs to be made to allow light-weight support and structure to the wearer's foot. Foam or resin of sufficient tensile strength can be bonded with the top or bottom surfaces to create a smooth surface, as will be obvious to those with skill in the art. Once these flat surfaces are in place, firm top 59 and bottom 28 surfaces can be attached to enclose the lattice. In some embodiments, it will be preferable to secure the surfaces with rivets into either or both of the lattice and foam material.

FIG. 7 illustrates another exemplary variation in the application of the present invention. The shoe 50 of FIG. 7 has a flat sole 51 of nominal thickness, the purpose of which is to support the foot of the wearer. Attached to the bottom surface of the sole is a heel 60 of the shoe 50, which is substantially under the heel of the foot of the wearer, and supports and elevates the heel of the foot. The heel 60 can be of varying heights, but will be at least one inch high. Various designs will desire that the heel 60 be formed of high-tensile metal, composits, or similar materials. For design purposes, and to lessen the weight of the shoe, it is preferable that the heel 60 be comprised of at least one passageway, and preferably, as described, multiple passageways.

Figure 8:
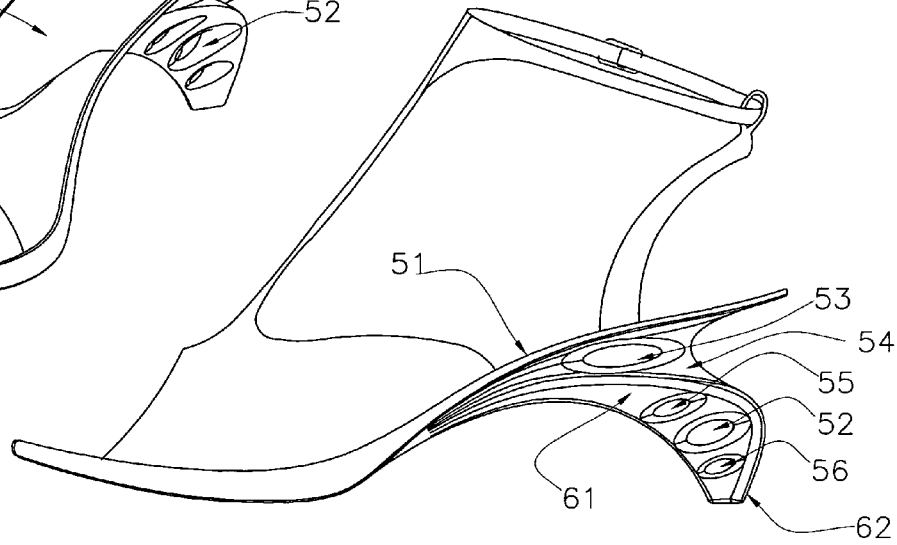
FIG. 8 is a side perspective view of the heel illustrated in FIG. 7, showing passageways through the heel formed within an aperture of the heel.
Figure 9:
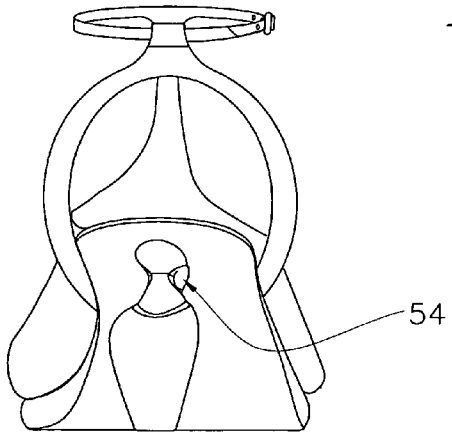
FIG. 9 is a rear perspective view of the heel illustrated in FIG. 7.

FIG. 8 further illustrates the flat-platform matrix of FIG. 7. From this perspective it is clear to see that heel portion of the matrix may in some variations be comprised of both an aperture and passageways. In this case, the aperture is an area of material that has been shaved away from the profile of the heel to reduce the weight. In this view, the medial side of the heel has two distinct apertures disposed within the medial side, a first aperture area in the top 54 and a second aperture area in the bottom 61. The apertures significantly decrease the mass of the heel 60 by giving it internal contour. Further, within each of the apertures 54, 61 are at least one passageway, which further reduce the mass and weight of the heel, and can be adapted in many different ways to accommodate the design goals for the shoe. In this particular embodiment, the first aperture 54 has one large elliptical passageway 53, and the second aperture 61 has 3 smaller elliptical passageways (52, 55, 56).

There is also provided with the invention a method of manufacturing a light-weight, integrity-enhanced, elevated sole and/or heel for a shoe. The design of the matrix is the first consideration in making the invention. An appropriate material needs to be chosen, which will be governed by the anticipated design aspects that will be inherent in the finished product, as will be demonstrated below and herein. The material is then formed into the general shape of the desired matrix. Several methods of orienting the general shape will be well-known by those with skill in the art, but will include cutting, milling, investment casting, and extrusion. Apertures or passageways are formed with sufficient number and size in the matrix to produce a finished lattice, bordering void space. Depending on the material, the apertures or passageways can be formed either during or after the formation of the matrix.

Where the material used to form the matrix is metal several options for finishing the lattice are available. The decision as to which method to use is largely governed by the design of the lattice and cost of manufacture. For example, the void space of FIG. 1 is formed by either milling or cutting. The lattice structure 16 of FIG. 1 has distinct shapes forming the contour of the sole and heel. These shapes are passageways from the medial to lateral sides of the shoe. A computer controlled 5-plane mill can cut these shapes and passageways with ease. Alternatively, a computer could be used for water-jet cutting or laser cutting. Aside from metal, composites, such as carbon fiber, and other non-traditional materials, such as plastic, butyl styrene, nylon, glass-filled nylon, and acrylic, can be used with these methods.

Alternatively, when the lattice structure is essentially a chassis matrix, as in FIG. 4, or where passageways or apertures have unique, non-linear shapes or patterns, then other methods are preferable. For example, investment casting or extrusion could be used to form the design of the chassis-style lattice of FIG. 4. In the case of a chassis-style lattice, such as in FIG. 4, preferably, a light-weight, high-tensile material, such as Oakley's proprietary X Metal®, aluminum, magnesium, or titanium are used to form the lattice structure.

A final method of forming the lattice of the shoe's matrix is by melting away part of the structure that fills the void space. The matrix 60 of the show of FIG. 7, could be formed in this manner. A matrix is formed of two materials. One material is cast or extruded into the lattice space, while another material is cast or extruded into the void space that will result in apertures or passageways, together forming a whole matrix. Then, the material in the void space is removed by a bevy of ways. The two materials could both be metals, where the second metal has a lower melting point. After forming the whole matrix, the matrix is heated to a temperature sufficient to melt the second material, or void space, but not the first material. This method is commonly known as de-alloying. Alternatively, the second material could be hydrophilic, and thus dissolve when introduced to water. The same could happen if the second material is introduced to a specific chemical or solvent.

Certain materials, such as foaming resin, can be used to create unique aperture designs within a matrix. Foaming resin is a material that hardens over a short period of time. A mold for a matrix is formed, into which the foaming resin is poured. As the resin hardens, bubbles rise within the matrix mold, which are ultimately trapped and give unique shape and design to the sole. The general mold for the matrix is removed, and the specific shape of the matrix is cut, revealing further apertures along the borders of the sides of the matrix.

Although the inventions have been described by reference to particular designs and illustrative embodiments, many variations in style and design are possible. The application of this invention to a legion of designs will be obvious to those with skill in the art. Included within the patent warranted on this description are all changes or modifications as may reasonably and properly be included within the scope of this contribution to the art.

What is claimed is:

1. An elevated support matrix for a shoe, comprising:

a shoe upper;

a substantially non-compressible, elevated support matrix having top and bottom surfaces, an anterior side, posterior side, medial side, lateral side, and connected to the upper and interfacing with a wearer's foot;

the entire matrix being formed from a metal;

the matrix having multiple passageways and each of which passageways extending entirely through the matrix from one side to the opposite side of the matrix; and the passageways extending through the matrix in such a manner as to optimize the structural support to the wearer's foot while minimizing the weight of the shoe.

2. The matrix as in claim 1, further comprised of at least five passageways.

3. The matrix as in claim 1, further comprised of at least ten passageways.

4. The matrix as in claim 1, further comprised of at least fifteen passageways.

5. The matrix as in claim 1, further comprised of at least twenty-five passageways.

6. An elevated support matrix for a shoe, comprising:

a substantially non-compressible, elevated support matrix, made substantially from a high-tensile material, to support a wearer's foot connected to an upper portion of a shoe;

the matrix having top and bottom surfaces, and an anterior side, posterior side, lateral side, and medial side;

the top and bottom surfaces, and anterior, posterior, lateral, and medial sides forming a shape of the matrix;

the matrix further being comprised of a lattice and a plurality of voids each extending entirely through the matrix from one side to the opposite side of the matrix, which voids are bounded by the lattice; and the lattice having a structure that maintains the structural integrity of the sole while minimizing the weight of the shoe.

7. The matrix of claim 6, wherein the voids extend through the sole from the medial side to the lateral side of the sole.

8. The matrix of claim 6, wherein the voids extend through the sole from the posterior side to the anterior side of the sole.

9. The matrix of claim 6, wherein a cross section of the voids is comprised of at least one general shape selected from the group consisting of a circle, square, triangle, hexagon, ellipse, rhomboid, trapezoid, rectangle, and honeycomb to fit the matrix.

10. The matrix of claim 9, wherein a cross section of the voids is comprised of a graduated size from the anterior side moving toward the posterior side.

11. The matrix of claim 9, wherein the voids further comprise some amount of radius of curvature at an intersection of all substantially linear bounds of the lattice surrounding said voids.

12. The matrix of claim 6, wherein a cross section of the voids is comprised of multiple different shapes.

13. An elevated support matrix for a shoe, comprising:

a substantially non-compressible, elevated matrix, made substantially from a high-tensile material, for supporting a wearer's foot formed of a material having sufficient structural integrity for maintaining the matrix in an initial configuration;

the matrix being bounded by top and bottom surfaces, an anterior side, posterior side, lateral side, and medial side, said matrix having a volume;

the matrix having a plurality of passageways extending entirely through it from one side to the opposite side;

the passageways defining voids bounded by a solid lattice, with the voids defining void space and the lattice defining solid space, with the void space equaling a defined volume and the solid space equaling a defined volume; and the void volume is at least 10 percent of the volume of the matrix.

14. The matrix of claim 13, wherein the total volume of void space is at least 25 percent of the volume of the matrix.

15. The matrix of claim 13, wherein the total volume of void space is at least 50 percent of the volume of the matrix.

16. The matrix of claim 13, wherein the total volume of void space is at least 80 percent of the volume of the matrix.

17. An elevated support matrix for a shoe, comprising:

a substantially non-compressible matrix to support a wearer's foot formed of a high-tensile material for maintaining the structural integrity of the sole in its configuration;

the matrix having at least one passageway extending entirely through it from a side of the matrix to an opposite side of the matrix;

the matrix having a complete volume by measuring the volume of the matrix as if there were no passageways;

the matrix also having a void volume by measuring the volume of the matrix as constructed;

wherein the void volume is between about 15 percent and about 95 percent of the complete volume.

18. The matrix of claim 17, wherein the void volume is between about 25 percent and about 95 percent of the complete volume.

19. The matrix of claim 17, wherein the void volume is between about 50 percent and about 95 percent of the complete volume.

20. The matrix of claim 17, wherein the void volume is between about 75 percent and about 95 percent of the complete volume.

* * * * *